United States Patent [19]

Balibrea

[11] 4,144,971

[45] Mar. 20, 1979

[54] GUN CADDY

[76] Inventor: Gabriel K. Balibrea, 5020 N. Grand Ave., Covina, Calif. 91722

[21] Appl. No.: 881,589

[22] Filed: Feb. 27, 1978

[51] Int. Cl.[2] ..... A47F 7/00

[52] U.S. Cl. ..... 211/64; 248/156

[58] Field of Search ..... 211/64, 60 R, 60 SK, 211/60 G, 60 T, 71; 248/156, 218.4, 219.2, 121, 176

[56] References Cited

U.S. PATENT DOCUMENTS

| | | | |
|---|---|---|---|
| 1,452,640 | 4/1923 | Hulick | 248/121 |
| 1,902,423 | 3/1933 | Seltzer | 248/156 X |
| 2,158,623 | 5/1939 | Fischbacher | 211/64 X |
| 2,869,729 | 1/1959 | Hayden | 211/64 |
| 3,007,581 | 11/1961 | Moore | 211/64 |
| 3,195,898 | 7/1965 | Respini | 248/156 X |
| 3,469,520 | 9/1969 | Foy et al. | 248/219.2 |
| 3,876,078 | 4/1975 | Gomes et al. | 211/64 |
| 3,952,878 | 4/1976 | Gorham | 211/64 |

*Primary Examiner*—Roy D. Frazier

*Assistant Examiner*—Terrell P. Lewis

*Attorney, Agent, or Firm*—Robert K. Wallor

[57] ABSTRACT

A portable, lightweight, earth engageable gun stand characterized by a rigid support shaft supported by a base member from which base member depend a plurality of stake members and strengthening bracing or webbing. The base member contains a secondary region, canted upward at its outer end and containing sufficient surface area so as to support the shoulder plate of a rifle or shotgun stock. Said base member support region also has provision, utilizing elevated flanges about its periphery, to preclude motion of such a direction coplanar to said support region. The rigid support shaft is also canted such that its downward extension intersects the extended plane of the base member support region in a generally orthogonal manner. The upper end of said support shaft contains one of a plurality of grip members, identically keyed to be interchangeable and to preclude rotation about said support shaft. Each of said grip members is individually configured to accept the barrel or barrels of one of a variety of rifles or shotguns.

3 Claims, 5 Drawing Figures

GUN CADDY

BACKGROUND OF THE INVENTION

This invention relates to gun racks generally, and more particularly to an earth engageable, portable gun rack particularly suited for supporting a rifle, shotgun, or the like, hereinafter referred to as a gun, in a safe, yet readily accessable attitude for use in hunting scenarios and other field use situations.

The several forms of gun racks found in the prior art were, in general, within Class 211, Subclass 64. In particular, the following patents were examined: U.S. Pat. Nos. 2,869,729 (T. S. Hayden); 3,007,581 (B. F. Moore); 3,876,078 (Gomes, et.al.): and 3,952,878 (Gorham).

U.S. Pat. No. 2,869,729 (Hayden) presents a circularly-based rack having a central shaft around which a plurality of guns may be placed and held in a generally upright position. It also provides for an external covering to protect the stored weapons. As opposed to the invention herein claimed, the Hayden device appears unnecessarily bulky and inconvenient for use as a temporary stand.

The Duck Hunter's Crutch of U.S. Pat. No. 3,007,581 (Moore) provides a collapsible stand whereon a gun may be placed when not in use. However, several disadvantages are detected which the invention herein has resolved. First, the mode of inserting the stand, or "crutch", into the earth, through use of a single shaft, may be readily tipped, particularly in soft terrain. The invention herein, utilizing a double shaft and a web base provides increased stability. This enhances the safety aspect of placing a loaded gun in the stand. A further potential disadvantage is observed in the method by which the gun is held in the Moore "crutch". Merely resting the gun barrel in the hook device at the upper end of the stand leads to the concern that a slight motion of the stand or a bump imparted to the gun could cause the barrel of the gun to disengage from the hook, thereby permitting the gun to fall.

The device of U.S. Pat. No. 3,876,078 (Gomes, et.al.) provides a portable gun rack that is supported by hanging it from a wall or other vertical structure of moderate height and thickness. The safety of this gun rack is dependent upon the rigidity and structural strength of the wall. It's use requires the presence of some structure to serve as a support.

The Gorham gun stand of U.S. Pat. No. 3,952,878 provides a means of storing, temporarily, two guns on a vertical shaft stand. The difficulty detected therein relates to safety. The apparently nearly upright storage position of the guns, and the absence of a positive grip upon the upper end of the gun barrel, shown as a hook, indicate that the possibility exists for the gun or guns to be easily tipped from the stand. The invention herein significantly reduces this problem.

SUMMARY OF THE INVENTION

The present invention considers the safety aspects of the use of weapons such as are to be stored in the stand described herein in that the base plate, upon which the gun stock rests, and the shaft supporting the upper barrel grip member are inclined at an angle such that the mass of the weapon about its center of gravity will tend to hold the weapon in the stand. The interchangeable barrel grip members placed upon the upper end of the shaft provide a positive friction grasp upon the barrel, providing further safety advantage. The configuration of the base members provides for positive placement of the stand into the supporting earth, while not permitting the stand to rotate about a vertical axis. None of the above advantages impede the ready accessability of the weapon to the user.

DETAILED DESCRIPTION OF THE INVENTION

Figure 1:
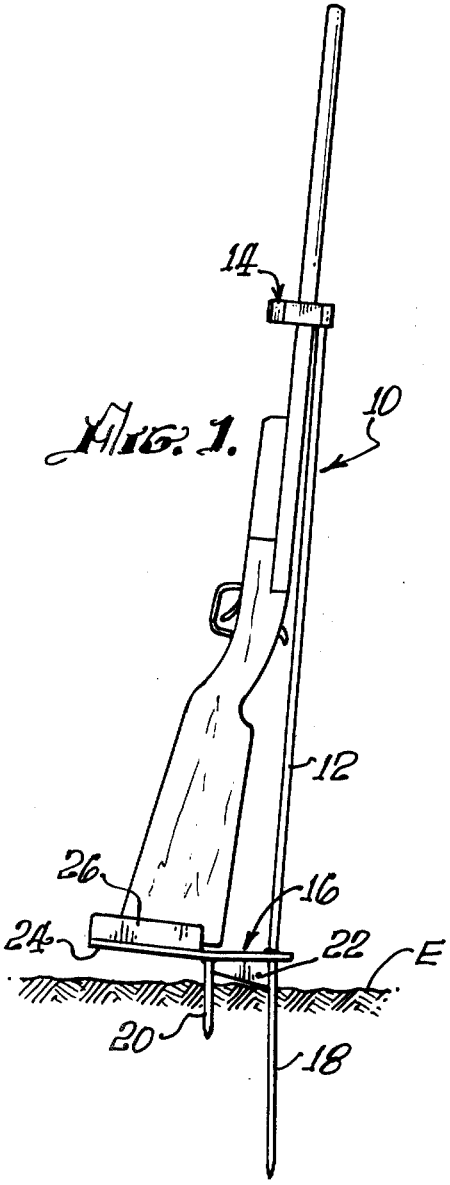
FIG. 1 is an elevational view of the new gun caddy in use, showing the placement of the gun caddy relative to the supporting earth surface.

Referring now to the drawings wherein like reference characters designate like or corresponding parts throughout the several views, there is shown in FIG. 1 a gun caddy, generally designated 10, which embodies the principles of the instant invention. While the gun caddy 10, as shown in the drawings, preferably is formed of stainless steel and similar materials, together with those special materials noted on the several drawings, it is to be understood that various materials, such as synthetic resins or plastics, may be employed in lieu of metallic and the specified special materials, where found desirable.

The gun caddy 10, in use, is placed and engaged in the ground surface E, as shown by FIG. 1.

Figure 2:
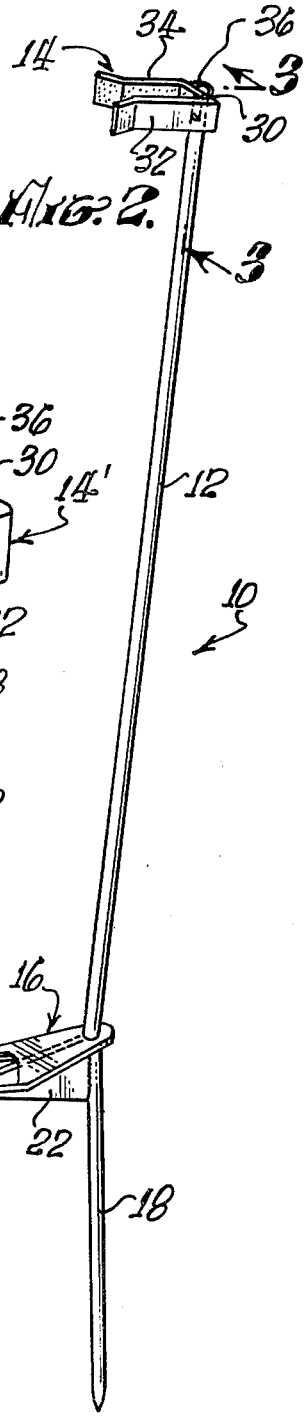
FIG. 2 is a perspective view of the gun caddy, illustrating the angular placement of the base and the support shaft, with the barrel grip member keying means shown by ghost images.

Referring now to FIG. 2, the gun caddy 10 includes an elongated shaft member 12, of right circular cylindrical cross section, having a flat key region formed longitudinally along a short region of the upper portion of the shaft member 12, said key region to be described in detail below. A grip member 14 is placed upon the upper end engaging said key region, said grip member 14 to be described more fully hereinafter. The lower end of shaft 12 is rigidly affixed to an irregularly shaped base member 16 from which depend two right circular cylindrical stake members 18, 20. Said stake members 18, 20 are rigidly affixed to the base member 16 such that the longitudinal axis of said stakes 18, 20 are situate orthogonally to the plane of the region of the base member 16 affixed to the shaft 12. The lower ends of said stakes 18, 20 are pointed to facilitate insertion into the earth surface. Spaning the upper portion of the separation between the two stakes 18, 20, and rigidly affixed to the base member 16 and to the stakes 18, 20, is a brace plate 22, to enhance the rigidity of the assembly and the stability when inserted into the earth.

Said base member 16 also provides a second region, hereinafter identified as the stock receptacle 24, unitarily formed with the balance of the base member 16, but having a dihedral angle formed about an axis in the plane of said member 16 normal to a line orthogonal to the longitudinal axis of stakes 18, 20, said angle causing the outermost end to be elevated relative to the reference earth surface. Said stock receptacle 24 would form an angle to said reference earth surface such that the shoulder stock of a typical shotgun or rifle may be placed on said stock receptable 24 causing the barrel to be inclined into the grip member 14 situated at the upper end of shaft 12.

Said stock receptacle 24 has a flange 26 formed or rigidly affixed thereto in a manner parallel to the vertical plane bisecting the base member 16 and passing through the longitudinal axis of stakes 18, 20. The glange 26 serves to prohibit transverse motion of the reference weapon shoulder stock. Compressible padding material, typically foam rubber, may be placed on the inner surfaces of the stock receptacle 24 and flange 26 to protect the weapon shoulder stock.

The aforementioned shaft 12, supporting grip member 14, is inclined relative to a line projected normally to the plane of the horizontal portion of base member 16, such inclination angle being formed in the plane bisecting the longer dimension of the base member 16 and normal thereto, such that the upper end of the shaft 12 bearing the grip member 14 is tilted away from the base member 16, thereby providing an even greater angle of repose to a reference weapon held by the gun caddy 10, beyond that imparted by the inclination of the stock receptacle 24.

Figure 3:
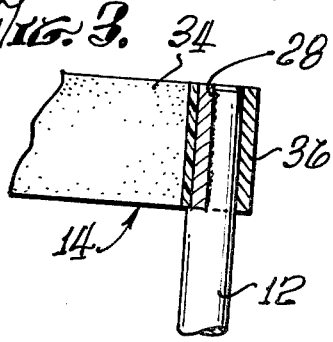
FIG. 3 presents a cross-sectional enlarged view of the upper end of the support shaft, further detailing the beying means for attaching the interchangeable barrel grip members.

Referring now to FIG. 3, wherein the key region of shaft 12 and the portion of grip member 14 are shown in cross sectional view, the flat key region 28 can be seen to match a hole placed through the grip member 14, thereby precluding rotation of the grip member 14 about the longitudinal axis of shaft 12. A further description of the key region of shaft 12 provides that the cross section normal to the longitudinal axis of shaft 12 in this region is semicircular in shape.

Figure 4:
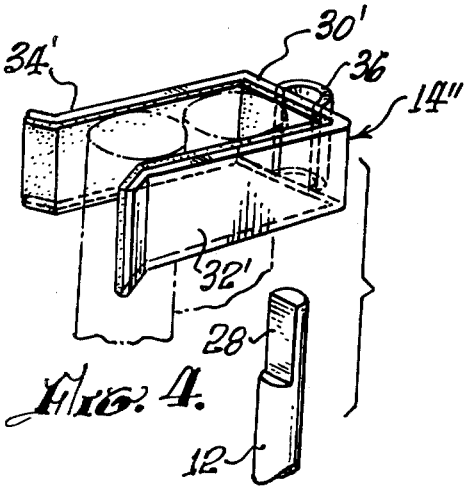
FIG. 4 shows, in exploded perspective, a representative barrel grip member configured for a typical over-and-under double-barreled shotgun.
Figure 5:
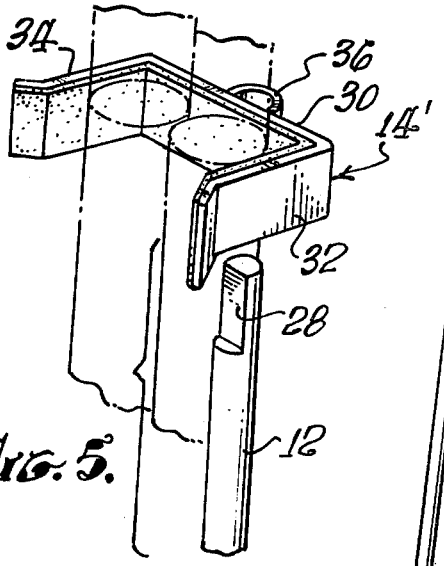
FIG. 5 is an exploded perspective of a barrel grip member configured for a side-by-side, double-barreled shotgun.

Referring now to FIG. 4 and FIG. 5, wherein interchangeable embodiments of grip member 14 of FIG. 2 are depicted, said grip member 14, 14', or 14'', is shown to be unitarily formed of bar stock or similar material into a generally U-shape 28 configuration, having the open-end of said U-shape 28 formed to provide an opening wider than the dimension of the web 30 spaning the two legs 32, 34 of the U-shape 28. The region immediately adjacent to this wider region is formed to be slightly constricted relative to said web 30 spanning dimension.

External to the U-shape 28, and situated mid-way along the web 30, is rigidly affixed an annular, open-ended, right cylindrical shaft key receiver 36. Said receiver 36, is oriented such that its axis is in the imaginary plane bisecting the web 30 and parallel to the U-shape member legs 32 and 34.

The inner regions of the U-shaped grip members 14, 14', 14'' may be lined with a compressible, elastic material, such as rubber, to protect the barrel or barrels of the referenced weapon being supported in the gun caddy 10, and also to provide added safety through increasing the friction forces retaining the weapon barrel within the grip member 14, 14', 14''.

Several versions of grip member 14 are illustrated to demonstrate the adaptability of the gun caddy 10 in that replacement of grip member 14 with grip member 14' would permit use of gun caddy 10 to support a double-barreled (side-by-side) shotgun. Similarly, replacement with grip member 14'' would permit use of gun caddy 10 to support an over-and-under configured double-barreled shotgun. Other grip member variants are envisioned to provide for various calibers of rifles, and for the several gauges of shotguns.

The dimensions of the preferred embodiment of the gun caddy 10 are such that a broad variety of weapons may be singly supported through having the length of shaft 12 be such that it is shorter than the shortest of the typical weapons suitable herein. The dimensions of the grip member 14 are tailored specifically to the particular weapon supported.

In use, the gun caddy 10 is carried by hand to the situs wherein it is to be used to support the weapon. The user then stands it on the ground surface and, by stepping on the base member 16, causes the stakes 18, 20 and a portion of the brace plate 22 to be driven into the earth. The user then engages the appropriate grip member 14 onto the upper end of the shaft 12. The gun caddy 10 is then ready to receive the weapon. The weapon shoulder stock is placed upon the stock receptacle 24, between the flange 26 and the barrel is inserted into the grip member 14. To prepare the shoot the weapon, the user merely grasps the weapon, disengaging it from the grip member 14, and from the stock receptacle 24.

The frictional forces of the grip member 14 and the angles provided by the stock receptacle 24 and the shaft 12 result in significant safety advantage in that the referenced weapon held by the gun caddy 10 reposes in a position of highly stable equilibrium, resistive to tilting and rotation.

Although the invention has been herein shown and described in what is conveived to be the most practical and preferred embodiment, it is recognized that departures may be made therefrom within the scope of the invention, which is not to be limited to the illustrative details disclosed.

Having described my invention, I claim:

1. A portable, earth-engaging gun caddy comprising an elongated irregularly-shaped base member having two regions, one of which assumes a horizontal position when the gun caddy is emplaced, and from which region depend two or more stake members and a brace plate member, used to engage the earth, and the other region, formed to slope upward at its outer extremity, and having upward protruding flanges parallel to the direction of slope, said second region serving as the receptacle for the shoulder stock of the supported weapon; a shaft member rigidly affixed to the base member at or near the end of said base member farthest removed from said sloping region of said base member, said shaft formed and attached so as to tilt away from said sloping region of said base member; and a family of grip members having differing dimensions conforming to the several weapons that may be singly supported by the gun caddy, but each such grip member generally being configured in a U-shape, such that a friction grip will be placed upon the weapon barrel, said grip members being interchangeably mountable upon the upper extremity of said shaft member by keyed-cylindrical means such that rotation about the longitudinal axis of said shaft member is precluded, with the particular grip member selected conforming to the weapon to be supported.

2. The structure set forth in claim 1 wherein said slope of the said second region of said base plate member and the said tilt of said shaft member, are equal in magnitude and of an angle of five degrees (5°) or more.

3. The structure set forth in claim 1 wherein said slope of the said second region of said base place member is at least ten degrees (10°) and the tilt of said shaft member is at least five degrees (5°), but said angles are unequal with said slope exceeding said tilt.

* * * * *